US009206536B2

(12) United States Patent
Kuhn et al.

(10) Patent No.: US 9,206,536 B2
(45) Date of Patent: Dec. 8, 2015

(54) LAYING DEVICE AND LAYING METHOD

(75) Inventors: Rudolf Kuhn, Neusäß (DE); Martin Rhotert, Dasing (DE); Hannes Pum, Alberndorf (AT); Klaus Minichshofer, Linz (AT); Norbert Kühl, Ungenach (AT)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 327 days.

(21) Appl. No.: 13/878,330

(22) PCT Filed: Oct. 7, 2011

(86) PCT No.: PCT/EP2011/067544

§ 371 (c)(1),
(2), (4) Date: Apr. 8, 2013

(87) PCT Pub. No.: WO2012/045858

PCT Pub. Date: Apr. 12, 2012

(65) Prior Publication Data

US 2013/0198998 A1 Aug. 8, 2013

(30) Foreign Application Priority Data

Oct. 7, 2010 (DE) ..... 20 2010 008 748 U

(51) Int. Cl.

| | |
|---|---|
| ***D04H 1/74*** | (2006.01) |
| ***D04H 1/736*** | (2012.01) |
| ***D04H 1/40*** | (2012.01) |
| ***D01G 25/00*** | (2006.01) |

(52) U.S. Cl.

CPC ..... *D04H 1/74* (2013.01); *D01G 25/00* (2013.01); *D04H 1/40* (2013.01); *D04H 1/736* (2013.01)

(58) Field of Classification Search

CPC ..... D01G 25/00; D04H 1/40; D04H 1/736; D04H 1/74

See application file for complete search history.

(56) References Cited

U.S. PATENT DOCUMENTS

| | | | | |
|---|---|---|---|---|
| 297,350 | A | 4/1884 | Clifton | |
| 2,899,583 | A | 8/1959 | Macksoud | |
| 3,682,734 | A * | 8/1972 | Burger | 156/166 |
| 4,992,124 | A * | 2/1991 | Kurihara et al. | 156/161 |
| 5,111,552 | A | 5/1992 | Lauren et al. | |
| 5,400,475 | A | 3/1995 | Hille | |
| 5,454,145 | A | 10/1995 | Wattel et al. | |
| 5,476,703 | A | 12/1995 | Wattel et al. | |
| 7,810,218 | B2 | 10/2010 | Dilo et al. | |
| 2002/0116793 | A1 * | 8/2002 | Schmidt | 19/296 |
| 2009/0217498 | A1 * | 9/2009 | Dos Santos et al. | 28/102 |
| 2012/0149272 | A1 * | 6/2012 | Hergeth | 442/381 |
| 2012/0279017 | A1 * | 11/2012 | Reussmann et al. | 19/3 |

FOREIGN PATENT DOCUMENTS

| | | | |
|---|---|---|---|
| AT | 310 045 | B | 9/1973 |
| BE | 904481 | A2 | 7/1986 |
| CN | 101012580 | A | 8/2007 |

(Continued)

*Primary Examiner* — Shaun R Hurley

(74) *Attorney, Agent, or Firm* — McGlew and Tuttle, P.C.

(57) ABSTRACT

A laying method and a laying device (2) are provided for laying a fibrous web (5, 37) with a prevailing fiber orientation (6). The laying device (2) has a material feed means (14), a laying unit (16, 17) and a discharging device (18), the laying unit (16, 17) laying the supplied fibrous web on the discharging device in material layers (9) with a consistent alignment and fiber orientation (6).

18 Claims, 5 Drawing Sheets

(56) References Cited

FOREIGN PATENT DOCUMENTS

| | | | |
|---|---|---|---|
| CN | 101400840 | A | 4/2009 |
| CN | 101538771 | A | 9/2009 |
| CN | 101654848 | A | 2/2010 |
| CN | 101713122 | A | 5/2010 |
| DE | 218 913 | A1 | 2/1985 |
| DE | 40 10 174 | A1 | 10/1991 |
| DE | 195 27 416 | A1 | 1/1997 |
| DE | 103 45 953 | A1 | 5/2005 |
| DE | 10 2005 032 785 | B4 | 2/2009 |
| DE | 10 2009 055 912 | A1 | 6/2011 |
| EP | 1 816 243 | A1 | 8/2007 |
| EP | 2 003 232 | A1 | 12/2008 |
| WO | 97/32069 | A1 | 9/1997 |
| WO | 2011/064103 | A1 | 6/2011 |

* cited by examiner 3
14
5
16,21
6
32
2
19,20
7
α
13
3
8
9
18
9
7
37
17
14
9
β
1
8
4

25
22
23
35
20
5,37
5,37
33
36
28
29
19
34
30
8
18,32,38

25
22
23
35
20
5,37
5,37
33
29
36
28
30
34
19
9
8
18,32,38

LAYING DEVICE AND LAYING METHOD

CROSS REFERENCE TO RELATED APPLICATIONS

This application is a United States National Phase application of International Application PCT/EP2011/067544 filed Oct. 7, 2011, and claims the benefit of priority under 35 U.S.C. §119 of German Utility Model DE 20 2010 008 748.1 filed Oct. 7, 2010, the entire contents of which are incorporated herein by reference.

FIELD OF THE INVENTION

The invention pertains to a laying device and a laying method for a material to be laid, especially a fibrous formed web with a prevailing fiber orientation, wherein the laying device has a material feeding means, a laying unit and a discharge device.

BACKGROUND OF THE INVENTION

Nonwoven laying devices for forming a multilayered nonwoven on a discharge belt are known from practice, wherein the nonwoven laying unit lays formed web being fed continuously in mutually overlapping layers on the discharge belt. Such a laying device is designed as a nonwoven laying device, wherein the discharge belt is moving during the laying of the formed web, with the consequence that the laid formed web layers show mutually crossing oblique alignments with layer formation in a zigzag pattern. The fibers may have a prevailing alignment in the formed web being fed, and they have, e.g., a prevailing direction component in the longitudinal extension and direction of run of the formed web being fed. These fiber orientations cross each other in the nonwoven, and the crossing angle is an obtuse angle greater than 90° because of the narrow closure of the layers.

It is known from U.S. Pat. No. 5,476,703 A that this crossing angle of the fiber orientations and also of the longitudinal extension of the laid formed web layers can be changed by a stretching means arranged downstream of the nonwoven laying device, which stretches the nonwoven and reduces the crossing angle in the process.

It is, furthermore, known from U.S. Pat. No. 5,454,145 A that the stretched nonwoven can be fed to another nonwoven laying device and another, new nonwoven material with multiply crossed fiber orientation can be formed on the discharge belt thereof by laying in a zigzag and scale-like pattern.

SUMMARY OF THE INVENTION

An object of the present invention is to provide an improved laying device and technique.

According to the invention, a laying device is provided for a material to be laid, especially a fibrous formed web with a prevailing fiber orientation. The laying device has a material feeding means, a laying unit and a discharge device. The laying device lays material layers, especially formed web layers, in the discharge direction separately from each other or overlapping each other to form a single-layer or multilayered nonwoven material on the discharge device. The laying device lays the material layers with constant alignment and fiber orientation on the discharge device.

The laying technique according to the invention has the advantage that nonwoven materials with a more uniform fiber orientation can be formed. Such nonwoven materials can have special strength properties that depend on the fiber orientation. It is favorable for this if the layers of the material or formed web to be laid have the same alignment of the layers and the same prevailing fiber orientations in the nonwoven material. The alignment of the prevailing fiber orientation can be adapted to the needs and set, with the alignment angle between the direction of laying or direction of feed and the direction of discharge being set correspondingly.

It is favorable for this form of material laying, especially formed web laying, and the formation of the nonwoven material if the material or formed web layers to be laid are separated from each other. This separation may take place before the laying on the discharge device, preferably in the area of the laying unit. A contiguous material or formed web can be fed on the inlet side and possibly stored in front of or within the laying unit. It is favorable for a constant alignment of the material or formed web layers to be laid if the discharge device is not moving during this laying operation. Laying may then be a defined one-dimensional transfer motion. A lifting means may now shorten the distance.

The laying technique being claimed has the advantage that highly sensitive material and formed web layers are handled especially gently. Disturbances in these layers during the transportation and deposition or transfer operation and corresponding adverse effects on the type and alignment of the laid material and formed web layers can be avoided.

Special advantages are offered by a laying technique with a nonwoven laying device and with an intermediate carrier arranged downstream, wherein said nonwoven laying device can ensure the intermediate storage of the material fed to it. The intermediate carrier may have a take-up side and a discharge side located opposite, wherein the cutting of a material or formed web being fed possibly continuously into individual pieces of material or formed web layers can take place in the area of the intermediate carrier, which is especially favorable for the accurate positioning and laying of the individual material or formed web layers. The intermediate carrier makes it possible to take up material or formed web already cut into individual pieces with a rolling motion on the feed or take-up side, to accurately position same on the discharge side and to transfer them by a one-dimensional laying motion at the discharge device with little need for aiming and little disturbance. The deposited material or fibrous formed web can be held in the intermediate carrier in a suitable manner in a controlled manner, for which a suction means is favorable. The material or formed web layers discharged and the single-layer or multilayered nonwoven material formed hereby can likewise be fixed in a suitable matter on the discharge device, especially by suction.

The laying technique being claimed has the advantage of high precision of laying in conjunction with a high level of freedom from disturbance. The construction and control effort is comparatively low. In addition, the possibility of handling different materials to be laid, especially fibrous formed webs, and to lay them to form a nonwoven material, is favorable. The desired fiber orientation can be set due to a variable alignment of the discharge device.

Furthermore, a plurality of laying units can be arranged one after another at a common discharge device, and these devices may also have different alignment angles. As a result, crosswise fiber orientations that may be desired can be set especially accurately. In addition, other materials to be laid, e.g., a reinforcing means in the form of webs, grids or the like, or other structure layers for building up the nonwoven material, can be inserted here in a specific manner and with little effort.

The laying technique being claimed meets the requirements imposed by modern, high-performance materials, especially carbon fibers or the like, and of technical nonwovens formed herefrom, which possess defined properties, in terms of precision especially well. In particular, such nonwovens can have, thanks to their exactly defined properties, especially their strength characteristics, a lower thickness than nonwoven materials used previously, which have more or less unordered fiber orientations, and the corresponding weight is reduced as well. This broadens and improves the possibilities of using such nonwoven materials, e.g., in the manufacture of automobiles and aircraft. Such nonwoven materials are also especially suitable for composites, in which case the nonwoven material is, e.g., bonded, especially impregnated with a synthetic resin or another suitable material before or during the process.

The laying device being claimed may be used as an individual device or as part of a fiber plant and in connection with an upstream formed web generator and a downstream bonding means for the nonwoven material.

The present invention is schematically shown in the drawings as an example. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
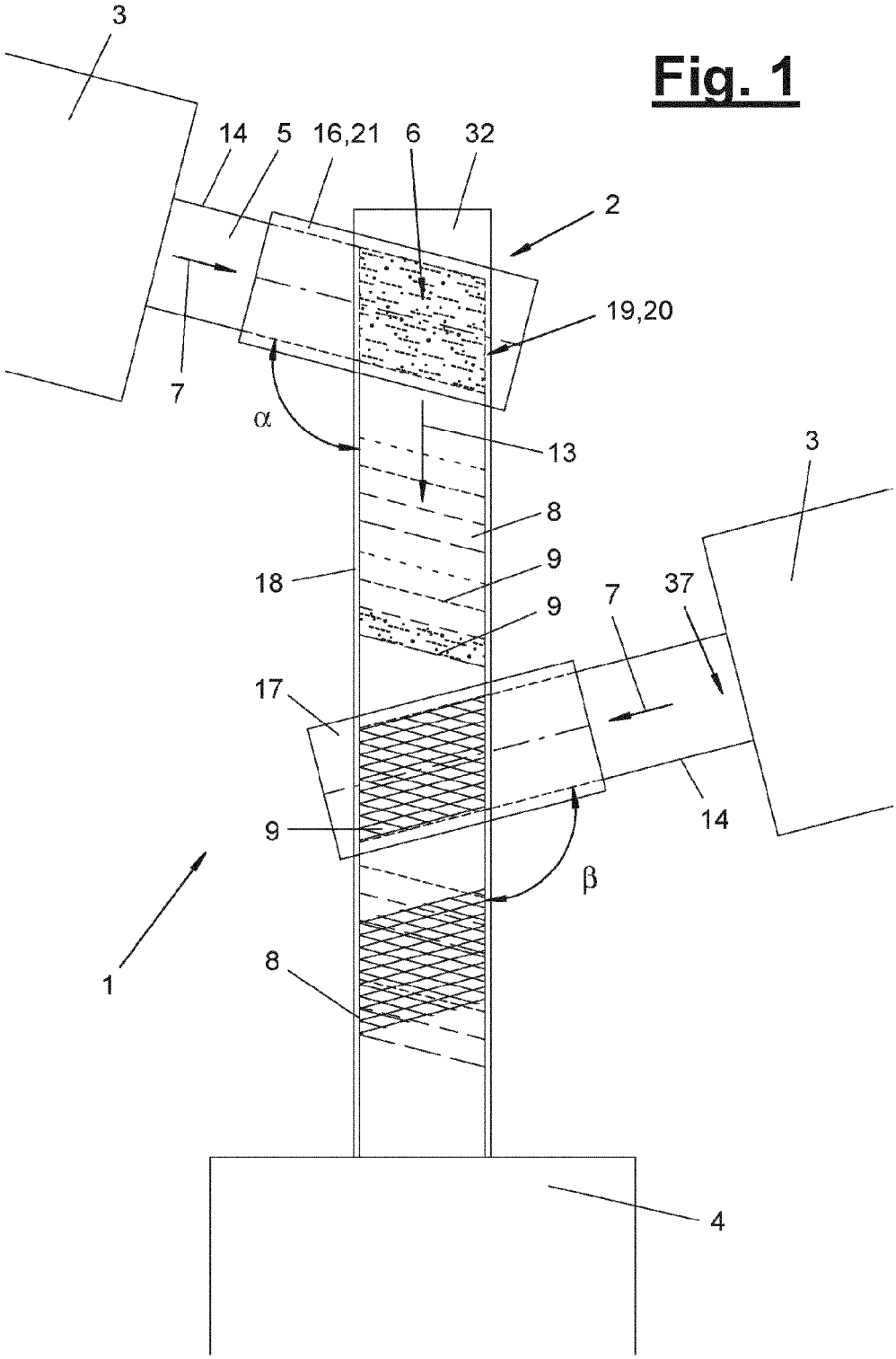
FIG. 1 is a schematic top view of a fiber plant with a laying device, a formed web generator and a bonding means.

Referring to the drawings in particular, the present invention pertains to a laying device (2) for a material (5) to be laid as well as a fiber plant (1) with such a laying device (2). The present invention pertains, furthermore, to a method for laying materials to be laid (5), especially fibrous formed webs, and for setting fiber orientations in a nonwoven material (8).

FIG. 1 schematically shows a fiber plant (1) with a laying device (2), with a plurality of material generators (3), especially formed web generators, and with a bonding means (4). The laying device (2) may have one or more laying units (16, 17) and one or more discharge device (18). Two laying units (16, 17) for identical or different materials (5, 37) to be laid are connected to a common discharge device (18) in the embodiment being shown. Furthermore, a feeding means (14), with which the material (5, 37) to be laid, which is arriving from the material or formed web generator (3) is fed in the direction of run (7), is associated with each laying unit (16, 17). The discharge device (18) has a preferably straight extension and a discharge direction (13) directed along its course.

The material to be laid (5, 37) is fed preferably continuously and in a running or closed or contiguous material web. As an alternative, intermittent and, e.g., piece-by-piece feed is possible.

The laying unit (16, 17) is used to lay the material to be laid (5, 37) at the discharge device (18) and to form a nonwoven material (8) in the process. For this, the laying unit (16, 17) places a plurality of material layers, especially formed web layers (9), on the discharge device (18) one after the other in the discharge direction (13). The nonwoven material (8) may be a multilayered material, and a plurality of these material or formed web layers are arranged one on top of another with overlap and with a longitudinal offset. Scale-like laying with closure of the layers is obtained hereby. As an alternative, the material layers (9) may be arranged individually and one after another and optionally at an axially spaced location to form a single-layer nonwoven material (8).

Figure 6:
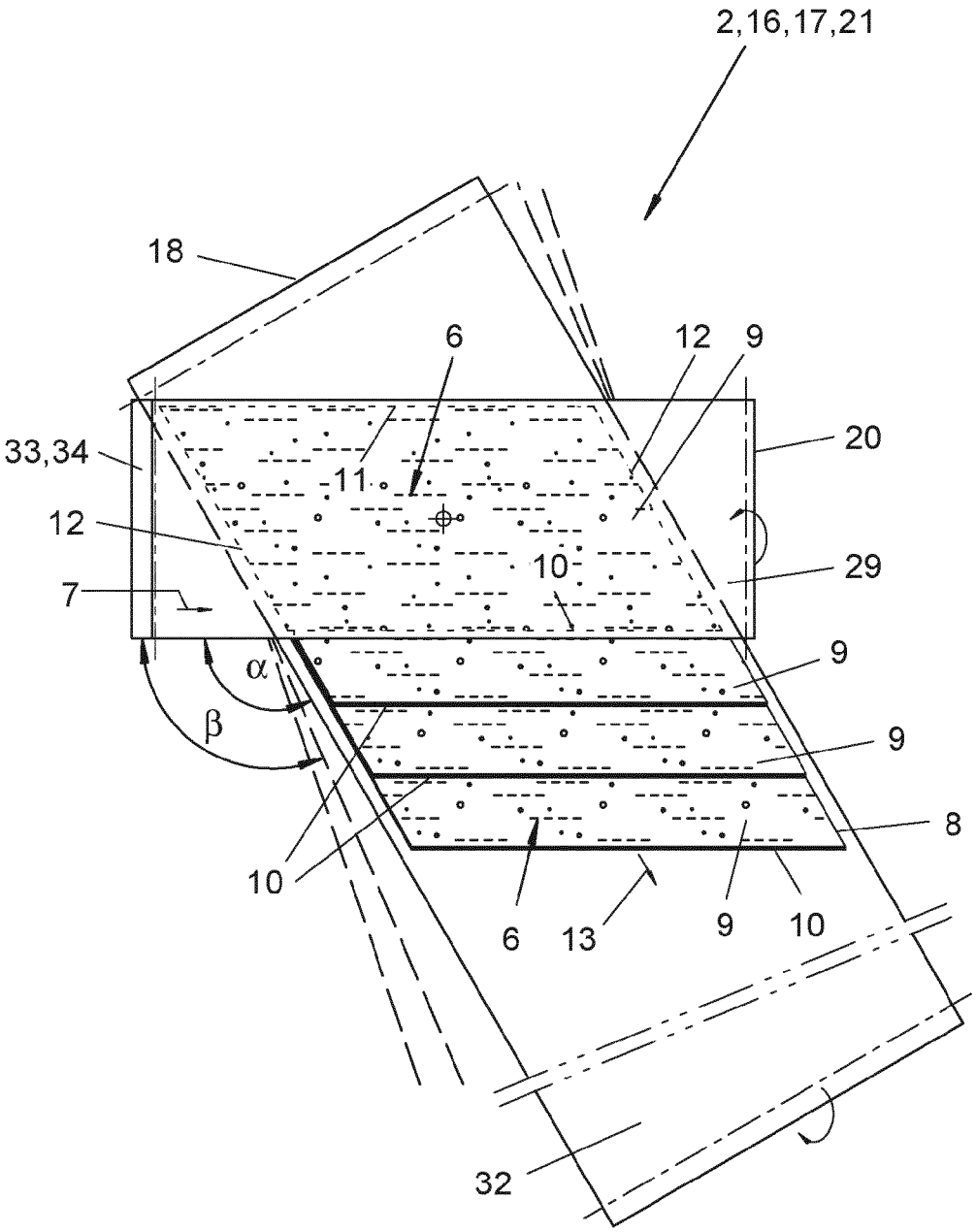
FIG. 6 is a top view of a laying device with representation of a prevailing fiber orientation and different crossing angles.

The laying unit (16, 17) has a laying direction (7), in which it lays the material or formed web layer (9) on the discharge device (18). The laying direction preferably coincides with the direction of feed (7). There may be a selectable alignment angle ($\alpha$, $\beta$) between the laying direction (7) and the discharge direction (13) as well as between the laying unit (16, 17) and the discharge device (18). As is illustrated in FIG. 6, the devices (16, 17, 18) may optionally be rotated about an axis relative to one another. The alignment angle ($\alpha$, $\beta$) may equal, e.g., 90°. The alignment angle ($\alpha$, $\beta$) differs from 90° in the embodiments being shown, so that the material or formed web layers to be laid are aligned obliquely to the discharge device (8).

The material or formed web layers (9) may be separated from one another and isolated from one another prior to laying. A cutting means (19) may be present for this at a suitable location and have a suitable design. The material to be laid (5, 37), which is fed on the inlet side, may form a contiguous web, especially a formed web, from which said material or formed web layers (9) are separated while forming individual pieces. This separation may take place in front of the laying unit (16, 17) or within the laying unit (16, 17).

The material to be laid (5, 37) may have the same design or different designs. In the exemplary embodiment being shown, the material to be laid (5), which is arriving from a first formed web generator (3), especially from a carder, is a fibrous formed web, which has a cotton wool-like form and consists of short-cut fibers, so-called stable fibers. The fibrous materials can be selected as desired. They may be, e.g., industrial fibers, especially carbon fibers, fibers made of plastics or natural fibers from cotton or the like. The fibrous formed web (5) may also contain other additional materials, e.g., metal filaments or the like.

As is illustrated in FIGS. 1 and 6, there may be a prevailing fiber orientation (6) in the material to be laid (5), especially the fibrous formed web. For example, the majority of fibers have here essentially the same direction component, which is directed, e.g., along the direction of feed (7) or in the longitudinal direction of the formed web. It is not necessary for all fibers to have the same alignment to be in parallel to one another. They may assume oblique positions and mutually hook into one another. There also may be some transversely directed fibers.

Another material to be laid (37), indicated in FIG. 1, may be, e.g., a web or a grid, which possibly also has a prevailing structure direction or orientation. Such a web (37) or grid may consist of textile fiber materials, metal, plastic or other materials. The material to be laid (37) may reinforce for this, e.g., a nonwoven material (8) consisting mainly of fibers or it may confer desired physical properties on it in another manner. The material generator (3) may have a corresponding design. A material or formed web generator is defined such that it also includes, besides means for producing said material to be laid (5, 37), feeding means, with which, e.g., a material to be deposited, which is produced in another manner, is prepared and fed in.

In a variant of FIG. 1 shown, the second or any further material to be laid (37) that is fed in may also be an identical fibrous formed web or a different fibrous formed web, which may have the same prevailing fiber orientation (6) or a different prevailing fiber orientation (6).

As is illustrated in FIGS. 1 and 6, the laying unit (16, 17) lays the material or formed web layers (9) with constant alignment and fiber orientation (6) on the discharge device (18). The material or formed web layers (9) thus have consistently the same alignment within the nonwoven material (8) being laid here. Furthermore, the laid nonwoven (8) and its material or formed web layers (9) may have the same prevailing fiber orientation (6). A selectable angle, which can be set by the above-mentioned alignment angle ($\alpha$, $\beta$), may be present between the longitudinal extension of the nonwoven material (8) and the fiber orientation (6).

If a plurality of laying units (16, 17) lay material and formed web layers (9) one after another on the discharge device (18), the alignment of these layers and the fiber orientation (6) may be the same. FIG. 1 shows a variant, in which the first laying unit (16) has an alignment angle ($\alpha$) and the second laying unit (17) has a different alignment angle ($\beta$). Layer alignments and fiber orientations (6) that cross each other can be set as a result with a selectable angle correlation.

Figure 2:
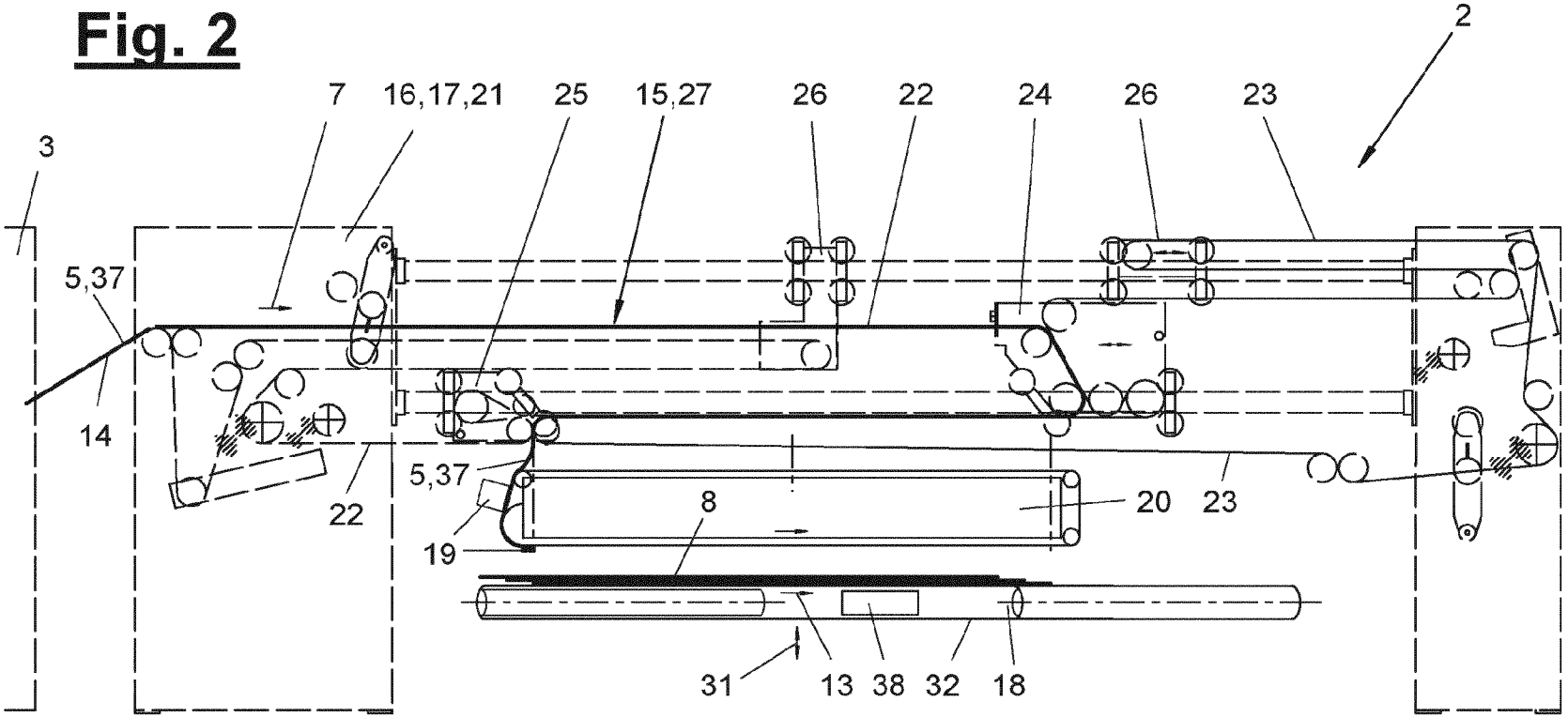
FIG. 2 is a schematic side view showing a laying device with a nonwoven laying unit with an intermediate carrier in one of different operating positions.
Figure 3:
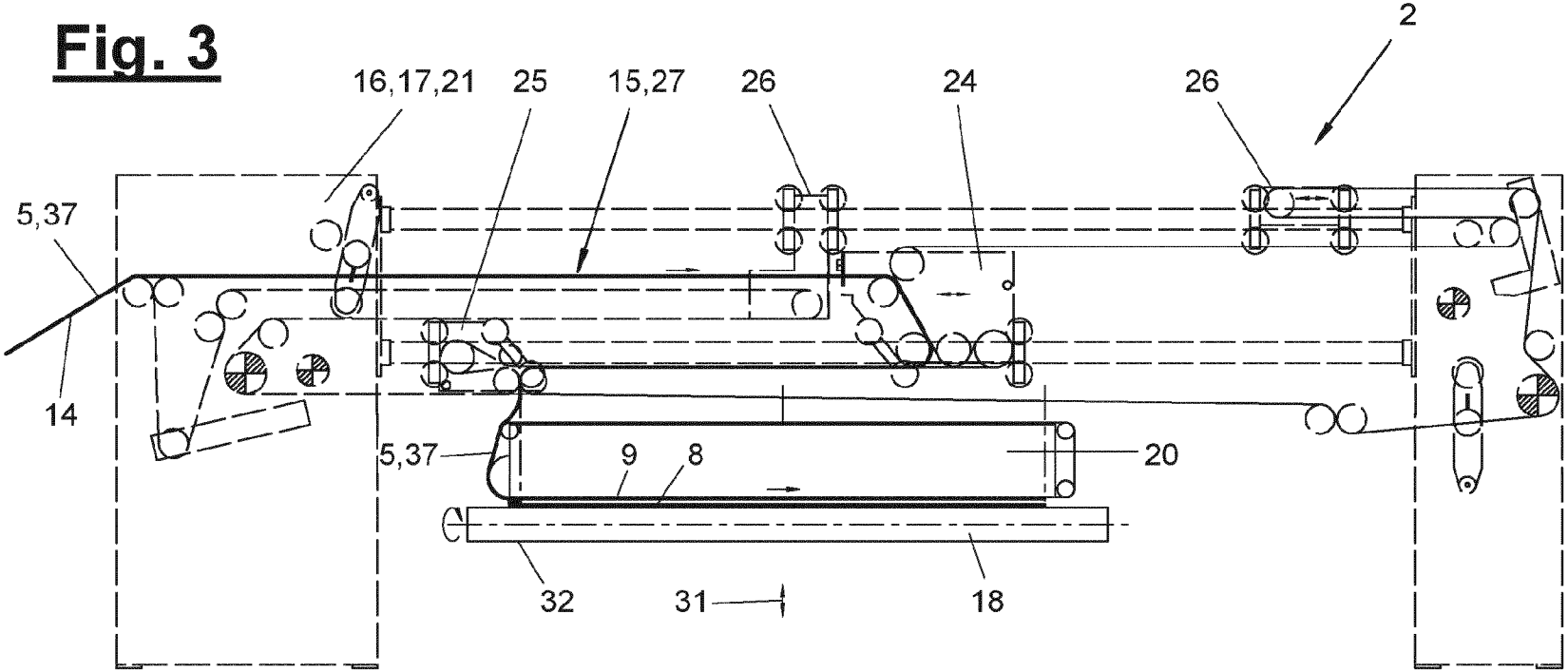
FIG. 3 is a schematic side view showing a laying device with a nonwoven laying unit with an intermediate carrier in another of different operating positions.

The discharge device (18) may have any desired and suitable design. In the exemplary embodiment being shown, it has a frame with a suitable conveying means (32), e.g., an endlessly running discharge belt. The discharge device (18) may have a controllable drive, which is preferably stopped during the material and formed web laying. The material or formed web laying by the laying device or laying units (16, 17) may take place intermittently and especially cyclically, and during the pauses between layings, when a new material and formed web layer (9) is formed or made ready, the discharge device (18) performed a delivering motion in the discharge direction (13). FIG. 2 shows the discharge device (18) in an oblique alignment in relation to the nonwoven laying unit (21) or the laying unit (16, 17). FIG. 3 shows, in a variation hereto, a transverse direction with an alignment angle ($\alpha$, $\beta$) of 90°.

The discharge device (18) may have, furthermore, a holding means (38) for the material and formed web layers (9) as well as the nonwoven material (8). This may have any desired and suitable design, e.g., in the form of a suction means, wherein suction takes place under the conveying means or discharge belt (32), which is correspondingly permeable to air. Furthermore, a cutting means for trimming the edges of the nonwoven material may be present at the discharge device (18).

The laying unit (16, 17) may have various designs. FIGS. 2 and 3 show a preferred embodiment with a design as a nonwoven laying unit (21). This may have a plurality of carriages (24, 25, 26) and a plurality of, especially two conveyor belts (22, 23) driven to run endlessly, which are each arranged in a closed loop and which extend, at least in some areas, closely adjacent to one another, and they take up and guide the material to be laid (5, 37) that is fed in between them in that area. The conveyor belts (22, 23) are guided via drivable rollers at the carriages (24, 25, 26).

At least one part of the carriages (24, 25, 26) is mounted displaceably on a machine frame and suitable guides in the direction of feed and laying direction (7). The nonwoven laying unit (21) is designed as a so-called belt type nonwoven laying unit and has a traveling upper carriage (24), at which the conveyor belts (22, 23), arriving from different directions, are merged. The material to be laid (5, 37), arriving from the feeding means (14), is taken up on one conveyor belt (22). The conveyor belts (22, 23) may be guided via one or more, especially two auxiliary carriages (26), which are likewise displaceable in direction (7), and with which differences in length are compensated in the belt loops formed. The conveying or laying belts (22, 23) are led in a parallel position with the material to be laid (5), which is being guided between them, to an adjacent lower carriage or laying carriage (25), at which the conveying or laying belts (22, 23) are again separated from each other and led away on both sides, with the material to be laid (5), which is released, exits downwardly at the laying carriage (25). The laying carriage (25) may likewise be displaceable in direction (7). As an alternative, it may be arranged stationarily.

The nonwoven laying unit (21) discharges the material to be laid (5, 37) intermittently and cyclically, and the discharge device (18) performs a delivery motion during the pauses between layings and discharges. If the material to be laid (5) is being fed constantly on the inlet side, the laying device (2) has a storage means (15), which intermediately stores the material to be laid (5) during said pauses between layings. The material storage means (15) is formed in the embodiment shown by a conveyor belt section (27), which has a variable length. A first partial section is formed by the conveyor belt (22) between the upper carriage (24) and the material input site or the connection site to the feeding means (14). The second variable partial section is formed between the two main carriages (24, 25). FIGS. 2 and 3 illustrate that the length of the belt section (27) and hence the size of the material storage means (17) is changed by the travel of the upper carriage (24), and the auxiliary carriage or carriages (26) takes (take) up the correspondingly varying remaining belt loop length. The carriages (24, 25, 26) and the laying belts (22, 23) have suitable controllable drives.

In another embodiment, not shown, a material or formed web storage means may be arranged in front of the laying unit (16, 17), e.g., in the area of feed unit (14).

In one embodiment, not shown, the nonwoven laying unit (21) can lay the material to be laid (5, 37), which is being discharged at a traveling laying carriage (25), directly onto the discharge device. A cutting means (19) may be arranged here in the area of the laying carriage (25) or at another location within or in front of the laying unit (16, 17). Laying carriage (25) travels back and forth in the laying direction (7) via the discharge device (18), stopping at the ends of its travel path, and the discharge of material at the laying carriage (25) is stopped, and a material to be laid (5, 37), which is being fed continuously, is taken up in the storage means (15) and then emptied during the next motion of the laying carriage. Laying carriage (25) can lay material or formed web layers (9) during forward and reverse travel. As an alternative, it can lay in one direction of travel only, and the material storage means (15) is being filled during travel in the opposite direction. Intermittent or cyclic laying takes place on the discharge device (18) in the different variants.

FIGS. 2 and 3 show a variant of the laying unit (16, 17), in which an intermediate carrier (20), which takes up the material to be laid (5, 37) exiting at the laying carriage (25), which is stationary here, in a take-up area (35) located at the top and releases same to the discharge device (18) in a discharge area (36) located at the bottom, is arranged between the nonwoven laying unit (21) and the discharge device (18). A lifting means (31), which is associated, e.g., with the discharge device (18), may be present here for mutually approaching the intermediate carrier (20) and the discharge device (18).

Figure 4:
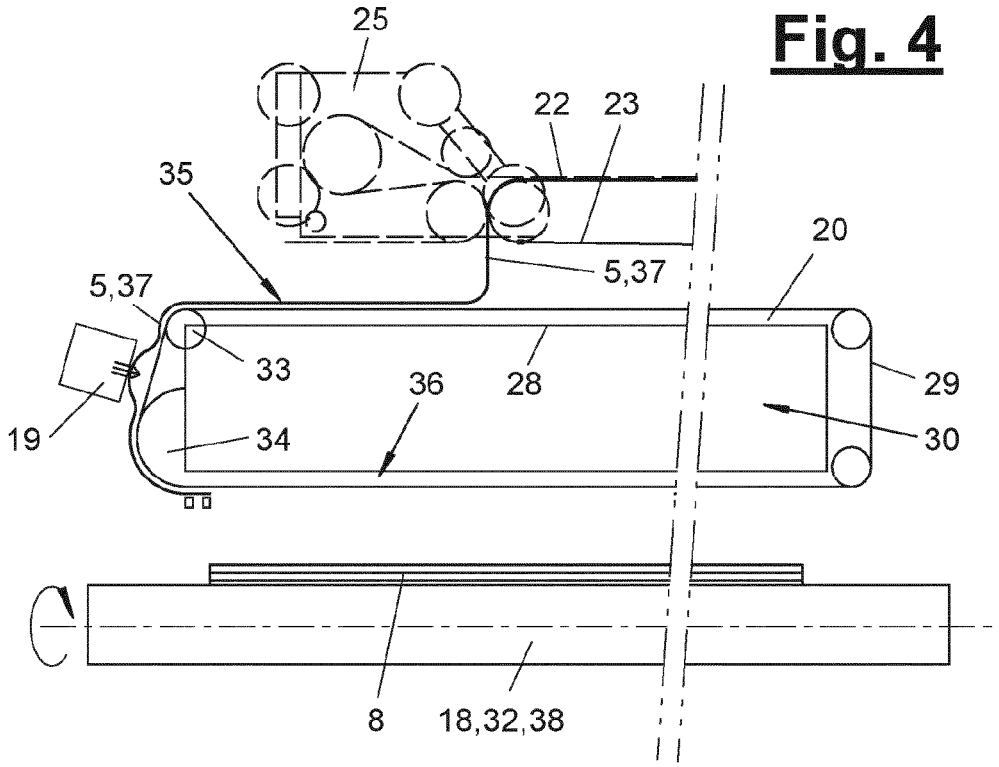
FIG. 4 is an enlarged and cut-away view of the intermediate carrier according to FIG. 2.
Figure 5:
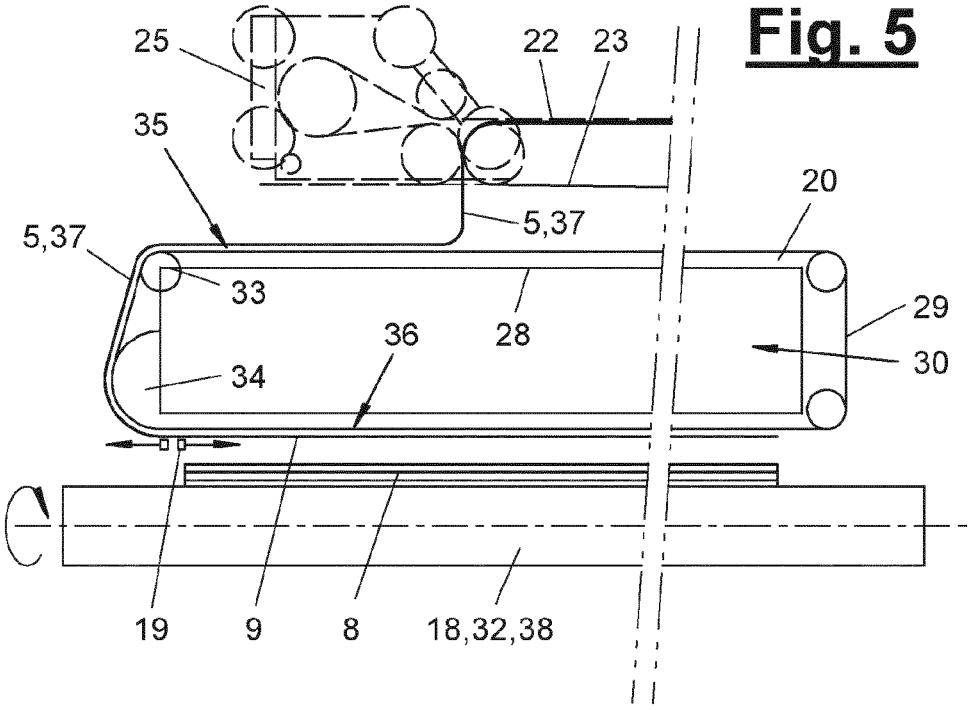
FIG. 5 is an enlarged and cut-away view of the intermediate carrier according to FIG. 3.

FIGS. 4 and 5 show details of the intermediate carrier (20) in different operating positions and in a cut-away and shortened front view.

Intermediate carrier (20) may be arranged stationarily or in a vertically adjustable manner by means of said lifting means (31). It comprises a frame (28) with a conveying means (29) for taking up and for conveying the material to be laid (5, 37) or a material or formed web layer (9). Conveying means (29) may be designed, e.g., as a conveyor belt running endlessly around the box-shaped frame (28) on the outside and have a controllable drive. An upper and a lower deflection means (34, 35) may be present for the conveying means (29) on one side of the frame, on which the material to be laid (5, 37) is led around, with the lower deflection means (34) projecting farther radially than the upper deflecting means (33), as a result of which a conveyor belt section dropping obliquely towards the outside is formed.

Intermediate carrier (20) may have a holding means (30), which is arranged, e.g., in frame (22) and can fix and release the material to be laid (5, 37) in a controlled manner. Holding means (30) may be designed, e.g., as a controllable suction means, in which case conveying means (29) and possibly also deflecting means (33, 34) are designed as means that are permeable to air. It may also be a multipart or variable means in order to be able to act differently on different areas of the intermediate carrier.

A cutting means (19), which forms a separated material or formed web layer (9) from the fed web-like material to be laid (5, 37), is arranged at the intermediate carrier (20) in this exemplary embodiment. Cutting means (19) may have various designs, e.g., it may be designed as a cutting means or as a tearing means. FIGS. 4 and 5 show both variants.

FIG. 4 shows one variant of a cutting means, wherein said cutting means (19) is located at the above-mentioned oblique belt section between the deflecting means (33, 34). The cutting means lifts off the material to be laid (5, 37) here from the conveyor belt section, forming a loop or a buckle, in which a cutting tool, e.g., a rotating knife, can cut through the material web (5) lying free. A pulling cut may take place here, as a result of which the material or formed web layer (9) will have an oblique edge. The cutting operation may happen during the conveying of the material.

In the variant according to FIG. 5, the cutting means (19) is designed as a tearing means and is located on the underside of the intermediate carrier (20). It may comprise, e.g., two clamping bars or other clamping or gripping means, which grip the material to be laid (5) and move apart from one another, while the material web is stretched and torn apart. The bars or the like may be directed in the alignment angle ($\alpha$, $\beta$).

The above-mentioned clamping bars, clamping rollers or other similar fixing means may also be present in the first variant with the cutting means. They are used here to fix and position the front area of the material web (36) remaining on the conveying means (29). They can also assume the same function in the second variant according to FIG. 5.

The laying carriage (25) is positioned at an edge area of the intermediate carrier (20) in FIGS. 2 and 3. FIGS. 4 and 5 show a variant of this with a laying carriage position shifted into the middle area of the intermediate carrier.

In all embodiments, the material to be laid (5, 37), which is exiting at the laying unit (16, 17), especially at the laying carriage (25), is taken up on the running conveying means (29), with the running velocity essentially corresponding to the velocity of discharge at the laying unit (16, 17) or laying carriage (25). The material to be laid (5, 37), which is taken up, is now fixed by the holding or suction means (30) during conveying.

The separation of the material web (5, 37) with the cutting means (19) takes place in an area of the intermediate carrier between the take-up area (35) and the lower discharge area (36). The material or formed web layer (9) now separated is then brought into a position suitable for discharge at the lower discharge area (36) by a corresponding conveying motion of conveying means (32). The starting area of the remaining material web (5, 37) can now follow.

The layer is subsequently transferred from the stopped position of the conveying means (29) and of the discharge device (18), possibly with the cooperation of lifting means (31). With the holding means (30) switched off, the intermediate carrier (20) releases the material or formed web layer (9), which will fall as a result on the rear area of the nonwoven and is possibly fixed here by the holding means (38). The formed web storage means (15) is being filled during this time. The discharge device (18) subsequently advances cyclically, and the conveying means (29) of the intermediate carrier (20) is again set into motion and material to be laid (5) is again laid on the take-up area (35) while the formed web storage means (15) is being emptied. The cycle is then repeated from the beginning.

As is illustrated in FIG. 6, the material or formed web layers (9) have a trapezoidal shape in case of an alignment angle ($\alpha$, $\beta$) differing from 90° and are cut off correspondingly obliquely for this. As a result, they have lateral layer edges (12) that are aligned in parallel to the discharge direction (13) and have front and rear parallel edges (10, 11) that extend obliquely to the discharge direction (13). The conveying cycle is coordinated in case of the closure of the layers mentioned in the beginning such that said edges (10, 11) overlap each one on top of another in scale-like layers (9).

Various variants of the embodiments shown and described are possible. A laying unit (16, 17) may also have a different design, e.g., it may be designed as a carriage nonwoven laying unit, camelback nonwoven laying unit or the like. The intermediate carrier (20) may also be combined with other variants of the laying unit (16, 17). Furthermore, the above-described features of the different exemplary embodiments may be combined with one another and mutually replaced with one another.

While specific embodiments of the invention have been shown and described in detail to illustrate the application of the principles of the invention, it will be understood that the invention may be embodied otherwise without departing from such principles.

The invention claimed is:

1. A laying device for a material to be laid, the laying device comprising:

a material feeding means;

a laying unit; and a discharge device, wherein the laying unit lays material layers in a discharge direction separately from each other or overlapping each other to form a single-layer or multilayered nonwoven material on the discharge device, wherein the laying unit lays the material layers on the discharge device, wherein the discharge device is aligned with an alignment angle at right angles or obliquely to a laying direction of the laying unit and the laying unit comprises a nonwoven laying unit comprising a belt type nonwoven laying device, with a plurality of carriages and a plurality of conveyor belts, which are led via the carriages in closed paths and take up the material to be laid and the laying unit, has a cutting means for cutting off the material layers.

2. A laying device in accordance with claim 1, wherein the discharge device moves the nonwoven material intermittently in the discharge direction, wherein the feed takes place during pauses between layings and the feed is stopped during the laying of a material layer and wherein the discharge device has a controllable conveying means comprising an endlessly running discharge belt, and a holding means for holding the nonwoven material.

3. A laying device in accordance with claim 1, wherein the laying device has a material storage means arranged in front of or in the laying unit.

4. A laying device in accordance with claim 1, wherein the nonwoven laying unit has a traveling upper carriage and a traveling or stationary laying carriage.

5. A laying device in accordance with claim 3, wherein the nonwoven laying unit has a traveling auxiliary carriage, wherein the material storage means is formed by a conveyor belt section of variable length in the area of the upper carriage.

6. A laying device in accordance with claim 1, wherein the laying unit has an additional intermediate carrier arranged above the discharge device for the material to be laid.

7. A laying device in accordance with claim 6, wherein the intermediate carrier is arranged between a stationary laying carriage of a nonwoven laying unit and the discharge device.

8. A laying device in accordance with claim 6, wherein the intermediate carrier and/or the discharge device has a lifting means for approaching one another.

9. A laying device in accordance with claim 1, wherein the laying unit has a cutting means for cutting off the material layers and the cutting means generates an oblique separation line in the material to be laid, which corresponds to the alignment angle.

10. A laying device in accordance with claim 6, wherein the intermediate carrier has a controllable holding means comprising a suction means, and a controllable conveying means comprising an endlessly running conveyor belt, which is permeable to suction, each for the material to be laid.

11. A laying device in accordance with claim 1, wherein the laying device has a laying device for a material to be laid, which material stabilizes the nonwoven material, that comprises a web or a grid.

12. A laying device in accordance with claim 1, wherein the laying device is connected to a formed web generator comprising a carder on a feed side, and with a bonding means for bonding the nonwoven material on an outlet side.

13. A laying device in accordance with claim 1, wherein the laying device is connected to a feeding means for feeding a contiguous material formed web.

14. A laying device in accordance with claim 1, wherein the material to be laid can be fed continuously to the laying device in a running material web.

15. A laying method for a material to be laid, the method comprising the steps of:

providing a laying device, which has a material feeding means, a laying unit and a discharge device; and with the laying unit laying material layers separately from one another or overlapping each other in the discharge direction to form a single-layer or multilayered nonwoven material on the discharge device, wherein the material layers are laid by a laying unit, which comprises a nonwoven laying unit comprising a belt type nonwoven laying device, with a plurality of carriages and with a plurality of conveyor belts, which are led via the carriages in closed paths and which take up the material to be laid and the nonwoven material is removed with an alignment angle at right angles or obliquely to the laying direction of the laying unit, wherein the material layers are separated and decollated from each other in the laying unit, before being laid and wherein the material layers are cut off in the laying unit, prior to laying, with a cutting means, from the material to be laid, which is fed in from a running material web.

16. A laying method for a material to be laid, the method comprising the steps of:

providing a laying device, which has a material feeding means, a laying unit and a discharge device; and with the laying unit laying material layers separately from one another or overlapping each other in the discharge direction to form a single-layer or multilayered nonwoven material on the discharge device, wherein the material layers are laid by a laying unit, which comprises a nonwoven laying unit comprising a belt type nonwoven laying device, with a plurality of carriages and with a plurality of conveyor belts, which are led via the carriages in closed paths and which take up the material to be laid and the nonwoven material is removed with an alignment angle at right angles or obliquely to the laying direction of the laying unit, wherein the nonwoven material is moved intermittently in the discharge direction with the discharge device, wherein the feed of the nonwoven material takes place during pauses between layings and is stopped during the laying of a material layer.

17. A laying method in accordance with claim 15, wherein a material to be deposited, comprising a fibrous formed web, consisting of industrial fibers, comprising carbon fibers, is laid.

18. A laying method in accordance with claim 15, wherein the material comprises a fibrous formed web with a prevailing fiber orientation wherein the laying unit lays the material layers on the discharge device with a constant alignment and fiber orientation.

* * * * *